US006764574B1

(12) United States Patent
Obeng et al.

(10) Patent No.: US 6,764,574 B1
(45) Date of Patent: Jul. 20, 2004

(54) POLISHING PAD COMPOSITION AND METHOD OF USE

(75) Inventors: Yaw S. Obeng, Orlando, FL (US); Edward M. Yokley, Pembroke Pines, FL (US); Kathleen C. Richardson, Geneva, FL (US)

(73) Assignee: psiloQuest, Orlando, FL (US)

( * ) Notice: Subject to any disclaimer, the term of this patent is extended or adjusted under 35 U.S.C. 154(b) by 101 days.

(21) Appl. No.: 09/938,150

(22) Filed: Aug. 22, 2001

Related U.S. Application Data

(60) Provisional application No. 60/273,685, filed on Mar. 6, 2001.

(51) Int. Cl.[7] ..... H01L 21/302

(52) U.S. Cl. ..... 156/345.12; 383/63; 383/113; 451/526

(58) Field of Search ..... 156/345.12; 451/287–290, 451/526, 921; 383/42, 63, 64, 113; 206/204, 205, 207

(56) References Cited

U.S. PATENT DOCUMENTS

| | | | | |
|---|---|---|---|---|
| 4,613,345 A | | 9/1986 | Thicke et al. | |
| 5,024,325 A | * | 6/1991 | Gundlach | 206/229 |
| 5,624,303 A | | 4/1997 | Robinson | |
| 5,698,455 A | * | 12/1997 | Meikle et al. | 438/8 |
| 5,913,715 A | * | 6/1999 | Kirchner et al. | 451/56 |
| 6,017,265 A | | 1/2000 | Cook et al. | |
| 6,063,306 A | | 5/2000 | Kaufman et al. | |
| 6,076,662 A | * | 6/2000 | Bahten | 206/207 |
| 6,099,954 A | | 8/2000 | Urbanavage et al. | |
| 6,106,754 A | | 8/2000 | Cook et al. | |
| 6,126,532 A | | 10/2000 | Sevilla et al. | |
| 6,132,298 A | | 10/2000 | Zunigna et al. | |
| 6,267,644 B1 | | 7/2001 | Molnar | |
| 6,283,829 B1 | | 9/2001 | Molnar | |
| 6,291,349 B1 | | 9/2001 | Molnar | |
| 6,293,851 B1 | | 9/2001 | Molnar | |
| 6,346,202 B1 | | 2/2002 | Molnar | |
| 6,352,595 B1 | * | 3/2002 | Svirchevski et al. | 134/3 |
| 6,354,915 B1 | | 3/2002 | James et al. | |
| 6,361,409 B1 | * | 3/2002 | Vishwanathan et al. | 451/56 |

(List continued on next page.)

FOREIGN PATENT DOCUMENTS

| | | | | |
|---|---|---|---|---|
| AU | 8665793 A | * | 6/1988 | A45D/29/17 |
| JP | 01-064776 | | 3/1989 | |
| JP | 8-078369 | | 3/1996 | |
| JP | 9-132661 | | 5/1997 | |
| JP | 11-245164 | | 9/1999 | |
| JP | 2001047355 A | * | 2/2001 | B24B/37/00 |
| WO | WO99-10129 | | 3/1999 | |
| WO | WO9962673 | | 12/1999 | |

OTHER PUBLICATIONS

Li, W. et al "The effect of the polishing pad treatments on the chemical–mechanical polishing of SiO2 films" Thin Solid Films 270, pp 601–606, 1995.*

(List continued on next page.)

*Primary Examiner*—Anita Alanko

(57) ABSTRACT

The present invention is directed, in general, to packaged polishing pads for chemical mechanical polishing of semiconductor wafers and integrated circuits. More specifically, the invention is directed to a method of preparing and packing the pad and the packaging therefor. Prior to placing the pad on a platen and polishing with the pad, a polishing pad having an hygroscopic absorbency is soaked with an aqueous media for a time sufficient to equilibrate the pad. The pad maybe packaged by placement in a sealable moisture tight package after soaking or before soaking along with a sufficient quantity of aqueous media to allow the pad to equilibrate.

14 Claims, 6 Drawing Sheets

U.S. PATENT DOCUMENTS

| | | | | | |
|---|---|---|---|---|---|
| 6,413,153 | B1 | | 7/2002 | Molar | |
| 6,428,388 | B2 | | 8/2002 | Molnar | |
| 6,435,948 | B1 | | 8/2002 | Molnar | |
| 6,454,634 | B1 | * | 9/2002 | James et al. | 451/41 |
| 6,468,911 | B1 | * | 10/2002 | Miyashita et al. | 438/692 |
| 6,585,574 | B1 | | 7/2003 | Lombardo et al. | 451/285 |
| 2002/0098789 | A1 | * | 7/2002 | Burke | 451/526 |
| 2002/0098790 | A1 | * | 7/2002 | Burke | 451/528 |

OTHER PUBLICATIONS

Li, I. et al "Dynamic Mechanical Analysis (DMA) of CMP pad materials" Mat. Res. Soc. Sump. vol. 613, pp E7.3.1–E7.3.10, 2000.*

Moinpour, M et al "Advances in Characterization of CMP Consumables" MRS Bulletin 27 (10) 766–771, Oct. 2002.*

* cited by examiner

POLISHING PAD COMPOSITION AND METHOD OF USE

CROSS-REFERENCE TO PROVISIONAL APPLICATION

This application claims the benefit of U.S. Provisional Application No. 60/273685 filed entitled "Polishing Pad composition and Method of Use," to Yaw S. Obeng, et. al., filed on Mar. 6, 2001, which is commonly assigned with the present invention and incorporated herein by reference as if reproduced herein in its entirety.

TECHNICAL FIELD OF THE INVENTION

The present invention is directed, in general to polishing pads for chemical mechanical polishing of semiconductor wafers and integrated circuits. More specifically, the invention is directed to a packaged polishing pad as well as a method of preparing or packaging a chemical mechanical polishing pad for polishing.

BACKGROUND OF THE INVENTION

Chemical-mechanical polishing (CMP) is used increasingly as a planarizing technique in the manufacture of VLSI integrated circuits. It has potential for planarizing a variety of materials in IC processing but is used most widely for planarizing metallization layers and interlevel dielectrics on semiconductor wafers, and for planarizing substrates for shallow trench isolation.

The success of CMP, over other methods such as etch-back; is due to the higher degree of wafer planarity that is achievable with the CMP technique since ever-increasing needs for miniaturization in electronic devices requires tighter wafer planarity tolerances. In CMP, a semiconductor wafer is polished using a repetitive, regular motion of a mechanical polishing wheel and a slurry which may contain a mixture of fine particles and chemical etchants. By placing the slurry between the polishing wheel and the wafer, unwanted material may be successfully removed with a high degree of planarity. To aid in the planarization process, the polishing wheel commonly employs a specialized polishing pad that may be made from felted or woven natural fibers such as wool, urethane-impregnated felted polyester, or various types of polyurethane plastic.

There are three critical consumable components in the CMP process. One is the abrasive liquid slurry. The abrasive liquid slurry's composition must be altered, and special formulations must be produced for each different substrate being polished. Some substrates require a high pH to be activated for polishing, and other substrates need a more acid environment. Still other substrates respond best to silica abrasives, while others require alumina or titanium abrasive particles. The second critical consumable component in the CMP process is the polishing pad. It must be very flat, uniform across its entire surface, and resistant to the chemical nature of the slurry and have the right combination of stiffness and compressibility to minimize effects like dishing and erosion. A third critical consumable component in the CMP process is the carrier film. The carrier film attaches the wafer to its rotating holder, must have an adequately flat and uniform in its thickness, must have an adhesive that will hold it tightly to the carrier but not too tightly to the wafer, all while being immune to the chemical environment in which it works.

One problem facing currently employed technologies is the degradation of the polishing pad material due to the chemically aggressive nature of the polishing slurry. Thus, the slurry chemistries cause the polishing properties to change drastically as the polishing process progresses, especially during initial exposure of the pad to the slurry. Rapidly changing polishing properties of the polishing pad are undesirable because control of the polishing's effect on the wafer is lost.

To address this problem, a technique called "seasoning" has been adopted. A conventional seasoning approach involves exposing the pad to a conditioning-polishing environment. The pad is attached to a plate, and in the presence of a conditioning slurry, a conditioning ring is used to condition the pad. During this conditioning process, a force is applied to the conditioning ring that mechanically forces the slurry into the pad. The pad is thereby seasoned or conditioned for actual semiconductor wafer processing. The pad is typically seasoned in this fashion for 30 minutes to 120 minutes. While this traditional seasoning technique is somewhat helpful, these prior art processes still suffer from certain disadvantages. For example, even after a pad is conventionally seasoned as mentioned above, the pad properties can continue to change, thereby affecting the quality of the wafer's polished surface.

Accordingly, what is needed in the art is method of preparing a polishing pad that does not suffer from the disadvantages associated with the prior art processes.

SUMMARY OF THE INVENTION

To address the deficiencies of the prior art, the present invention, in one embodiment, provides a method of preparing a polishing pad suitable for chemical mechanical polishing of a semiconductor wafer. In this embodiment, the method includes providing a polishing pad having a hygroscopic absorbency, soaking the polishing pad with an aqueous medium for a time sufficient to equilibrate the pad to prior to polishing with the pad, and placing the polishing pad on a polishing platen subsequent to the soaking.

In another embodiment the present invention provides a method of packaging a polishing pad for use in polishing a semiconductor wafer. This particular embodiment includes placing a polishing pad in a container configured to retain an aqueous medium therein, placing an aqueous medium in the container in a quantity sufficient to allow the polishing pad to equilibrate, and sealing the container.

Yet another embodiment provides a packaged polishing pad, comprising a sealable moisture tight package having a dimension sufficient to contain a polishing pad therein and a polishing pad soaked in an aqueous medium and located within the sealable moisture tight package.

The foregoing has outlined preferred and alternative features of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention. Those skilled in the art should also realize that such equivalent constructions do not depart from the spirit and scope of the invention in its broadest form.

BRIEF DESCRIPTION OF THE DRAWINGS

For a more complete understanding of the invention, reference is now made to the following descriptions taken in conjunction with the accompanying drawing, in which.

DETAILED DESCRIPTION

Figure 1:
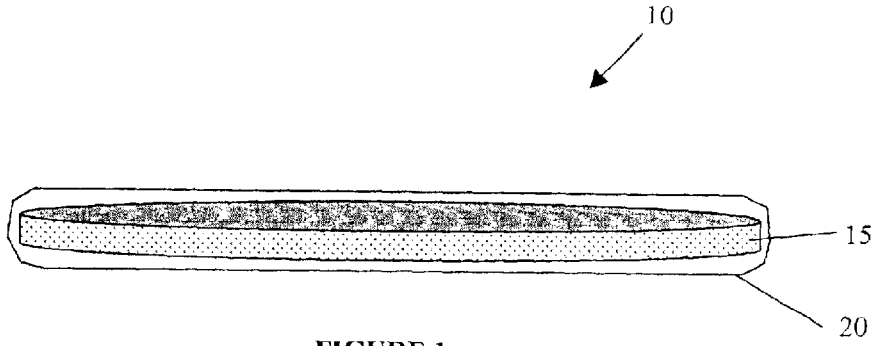
FIG. 1 illustrates an exemplary embodiment of a packaged polishing pad of the present invention.

Dynamic Mechanical Analysis measurements are well known to provide information related to the mechanical properties of polishing pad materials. Usually these properties are measured as a function of temperature and the results correlate with the storage modulus (G') and the loss modulus (G") of the material. The ratio of the loss modulus to the storage modulus, (G"/G'), is a measure of the internal friction within a material and is referred to as tan δ or damping. Peaks in the tan 6 curve correlate with glass transition temperatures, Tg, of the polymeric polishing pad material. Thus, changes in the mechanical properties of polishing pad materials may be monitored using this technique. By comparing the mechanical properties of polishing pad materials before soaking and thereafter, pad materials may be altered to provide improved polishing. It has been unexpectedly found that if a polishing pad is soaked for an extended period of time, at ambient temperature and pressure, the polishing pad provides a polishing quality superior to a polishing pad seasoned in accordance with the above-mentioned conventional methods.

In one aspect, the present invention provides a method of preparing a polishing pad suitable for chemical mechanical polishing of a semiconductor wafer. In an initial step, the method includes providing a polishing pad having a hygroscopic absorbency. The method may continue by soaking the polishing pad with an aqueous medium at about 10° C. to about 50° C. and ambient pressure (e.g. room temperature ~24° C.), and preferably ambient temperature (e.g. 1 atmosphere), for a time sufficient to equilibrate the pad. Subsequently, the polishing pad is placed on a platen for use in polishing.

The time required to equilibrate the pad will vary, depending on the material from which the pad is made; however, this can be monitored by measuring the uptake of water as a function of time. As used herein, equilibrating the pad means that a pad it material has absorbed at least about 10% to about 50% or more of the pad's maximum absorbency, and more preferably at least about 50% or more. For example, in one particular embodiment, the pad may be soaked for a period of time ranging from about 3 hours to about 2 weeks. In other embodiments, the soaking is performed for a time ranging from about 3 hours to about 48 hours, while in others the soaking may last from about 15 hours to about 30 hours.

While the present invention envisions any material having an affinity to absorb water and that can be used to polish a surface, in certain embodiments of the method, the pad material may comprise thermoplastic polymers such as 6,6 nylon, 6,12 nylon, polyketone; or polyurethane. In other embodiments, the pad material may comprise a monomer of a thermosetting plastic, such as urethane. In preferred embodiments, the polishing pad is soaked prior to attaching the polishing pad to a polishing platen, however, other embodiments may be directed to a method of soaking the polishing pad under the above-mentioned conditions and while on the polishing platen.

To simulate a polishing environment, the method may include soaking the pad in an aqueous media at about 10° C. to about 50° C. and ambient pressure, and preferably ambient temperature, that includes an additive. Certain polishing methods are performed in a basic environment. Thus, soaking the pad may involve soaking the pad in a basic buffer solution. Basic buffers suitable for use in the present invention may have a pH ranging from about 7.0 to about 14.0. In an exemplary embodiment, the basic buffer may have a pH ranging from about 9.0 to about 11.0.

Alternatively, other polishing procedures are performed in an acidic medium. In those situations, the pad may be soaked in an acidic buffer. The acidic buffer may have a pH in the range of about 2.0 to about 7.0. In certain embodiments the acidic buffer may have a pH in the range of about 3.0 to about 5.0.

The aqueous medium may include other additives to further simulate the polishing process. For example, the additives may be an oxidant that can be used in a polishing slurry. In other embodiments the additive may be an abrasive, such as silica or alumina, although other abrasives known to one skilled in the art may be used as well. In still others, the additive may be an organic amine, such as ethanol amine.

Now turning to FIG. 1 there is illustrated a packaged polishing pad 10 according to the present invention. The packaged polishing pad includes a polishing pad 15 and a sealable moisture tight package 20 having a dimension sufficient to contain the polishing pad 15 therein. The pad 15 of the packaged polishing pad 10 may comprise any material having a sufficient hygroscopic absorbance, including thermoplastic polymers such as 6,6 nylon; 6,12 nylon; polyketone; or polyurethane. The packaged polishing pad 10 may include an additive in an aqueous media, such as the buffers, oxidants, abrasives, and organic compounds discussed above. The sealable moisture tight package 20 may be formed from any material that will inhibit evaporation of the aqueous medium. In certain embodiments, the sealable moisture tight package 20 comprises a flexible plastic material, although other materials including a rigid plastic would also be suitable. However, the package 20 must be chemically resistant to degradation by any additives in the aqueous medium.

Figure 2:
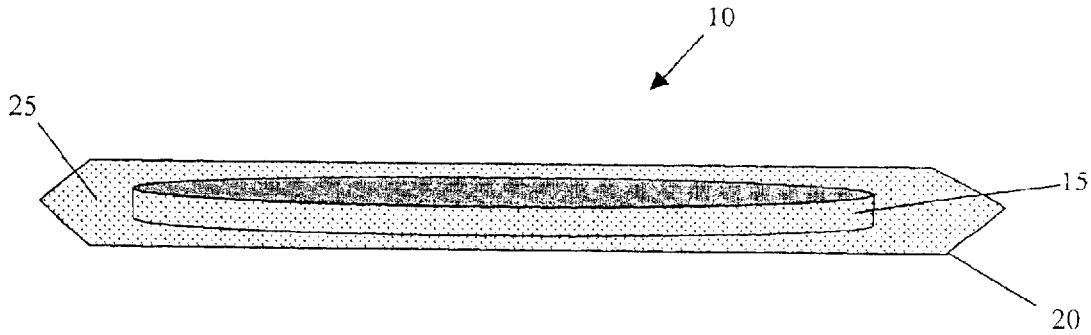
FIG. 2 illustrates an alternate exemplary embodiment of a packaged polishing pad according to the present invention.

Referring now to FIG. 2, there is illustrated an alternate embodiment of the packaged polishing pad 10 of the present invention. This embodiment includes the packaged polishing pad 10 and polishing pad 15 located in the sealable moisture tight package 20. This embodiment also includes an aqueous medium 25, and may include one or more of the above-described additives, within the sealable moisture tight package 20 for soaking the pad.

Figure 3:
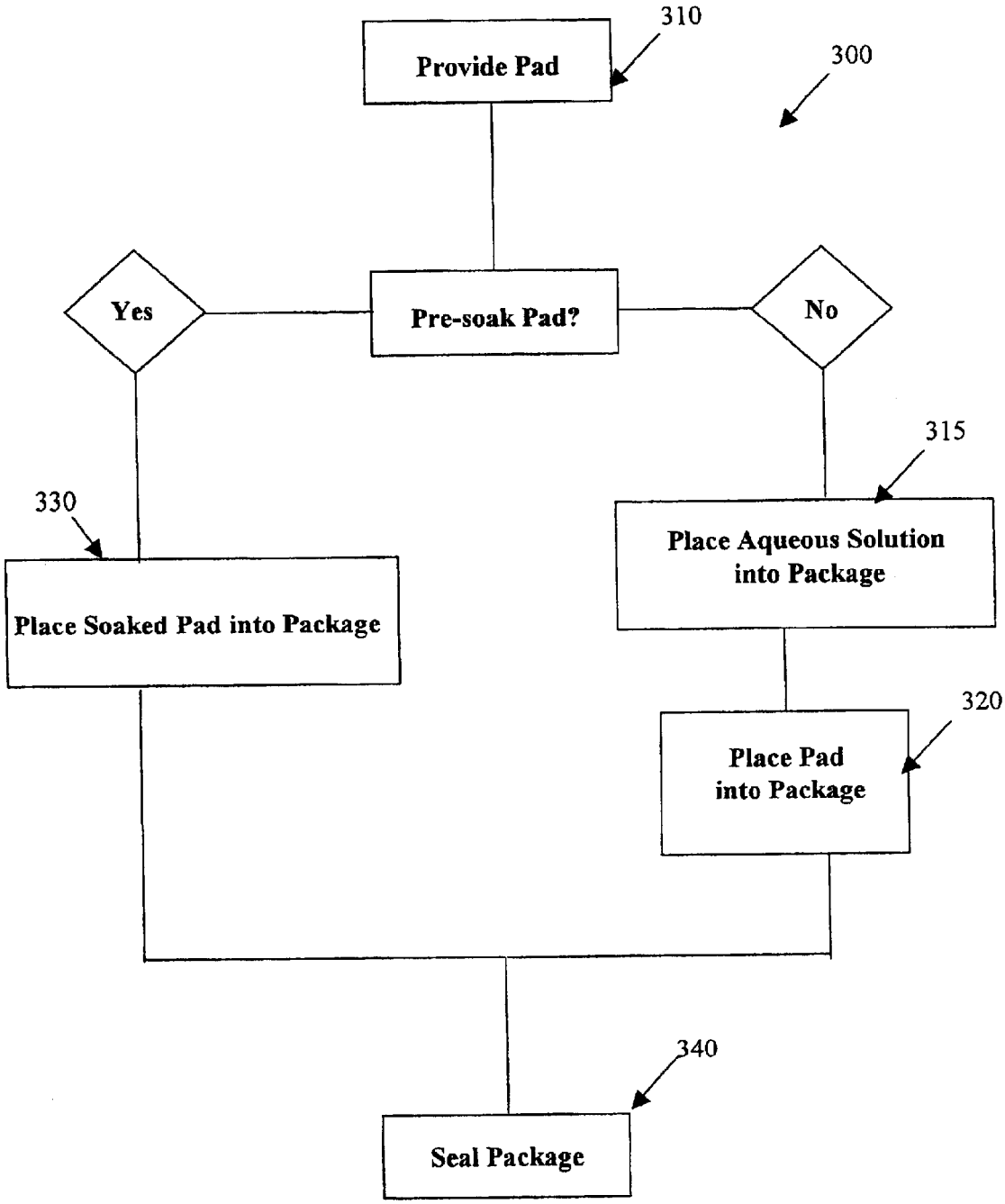
FIG. 3 illustrates a flow diagram of an exemplary method of packaging a polishing pad according to the present invention.

Referring now to FIG. 3, in another embodiment, the present invention provides a method 300 of packaging a polishing pad for use in polishing a semiconductor wafer. In this embodiment, the present invention begins by providing a pad 310. In embodiments of the method 300 where the polishing pad is pre-soaked, the method 300 continues at 330 by placing the polishing pad into a container comprising a sealable moisture tight package. In such embodiments, the method 300 ends by sealing the sealable moisture tight container at step 340. The container may be sealable by any means known in the art that retains the aqueous medium. For instance, mechanical sealing may be accomplished by twist-tying or interlocking mechanisms, such as zip-loc technology. Alternatively, the sealing may also be accomplished by heat-sealing. Such sealing methods are well-known in the art.

In embodiments of the present invention where the polishing pad is not pre-soaked with an aqueous solution, providing a pad 310 is followed by placing an aqueous solution into the sealable moisture tight package at step 315. The method continues at 320 by placing the pad into the sealable moisture tight container. The method 300 ends by sealing the container as step 340 as described above.

Embodiments of the method 300 preferably includes consideration of the following factors. Whether the pad is pre-soaked or placed into the package with the aqueous medium, the amount of the aqueous medium should be sufficient to allow the polishing pad to equilibrate. The amount of aqueous medium needed to sufficiently equilibrate the pad should be determined by measuring the pad's maximum absorbency, i.e., the amount of water a pad material is capable of absorbing. In certain embodiments, the aqueous medium may also include any desirable additives therein. In some embodiments, the desirable additives may be added after the pad is placed in the container.

EXAMPLES

Figure 4:
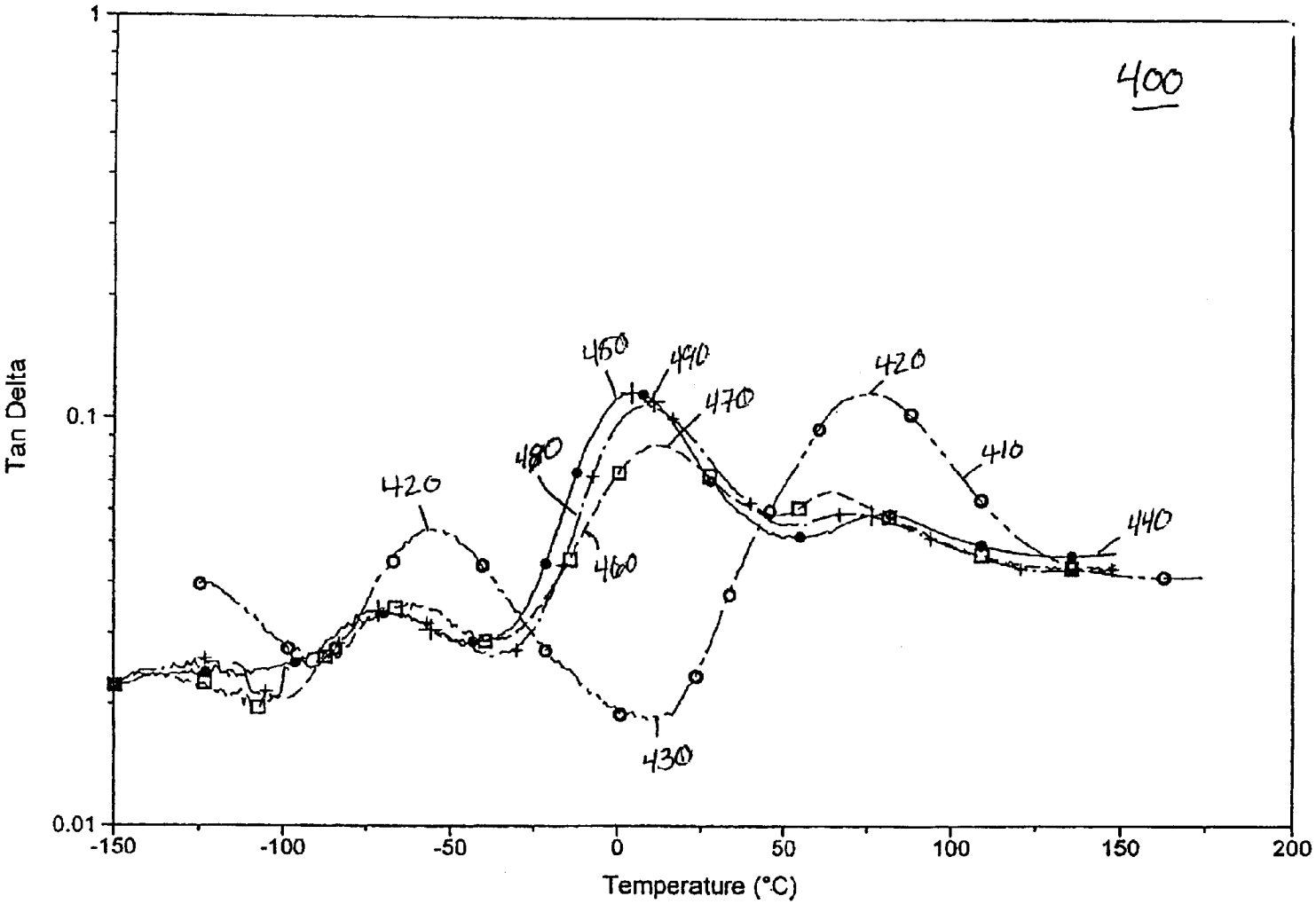
FIG. 4 illustrates the Dynamic Mechanical Analysis behavior of a 6,6 nylon polishing pad as a function of temperature.

Nylon materials were first studied. Examples of suitable nylon materials are commercially available from E. I. du Pont de Nemours and Company under the trade name Zytel™ 101L and Zytel™ 1511-L. Referring initially to FIG. 4, there is illustrated the dynamic mechanical analysis (DMA) behavior 400 of a typical 6,6 nylon polishing pad sample both before soaking in an aqueous solution and after soaking. As FIG. 4 indicates, DMA behavior before soaking is illustrated by line 410. The pre-soak behavior 410 is characterized by peaks 420 at about −55.8° C. and 76.2° C. and a minimum 430 at about 15° C. The behavior after soaking in water for 2 weeks is illustrated by line 440. Line 440 has a pronounced maximum 450 of about 0.1 at about 4.2° C. Additionally, the 6,6 nylon material was soaked in water in the presence of a pH 10 buffer and silica to simulate a polishing slurry. Its behavior is illustrated by line 460. As lines 440 and 460 illustrate, the behavior of the material soaked in buffer and silica is substantially similar to that soaked in water. The maximum 470 in the buffer soaked pad has shifted to slightly higher temperature, about 11.0° C. FIG. 4 also shows the DMA behavior of a 6,6 nylon pad soaked in an acidic buffer, pH 4, in the presence of alumina. This behavior is illustrated by line 480. Again, the behavior is substantially similar to the water-soaked sample, and the maximum 490 of the DMA test has shifted to about 11.0° C. Thus, the soaking experiments indicate that exposure to water has a dramatic impact on the mechanical properties of a polishing pad material. This data is summarized in TABLE I.

TABLE I

| Pad material | Soak Medium | Additive | DMA Maxima | DMA Minima |
|---|---|---|---|---|
| 6,6 Nylon | none | none | −55.8° C., 76.2° C. | 15° C. |
| 6,6 Nylon | water | none | 4.2° C. | — |
| 6,6 Nylon | water | acidic buffer/$Al_2O_3$ | 11.0° C. | |
| 6,6 Nylon | water | basic buffer/$SiO_2$ | 11.0° C. | — |

Figure 5:
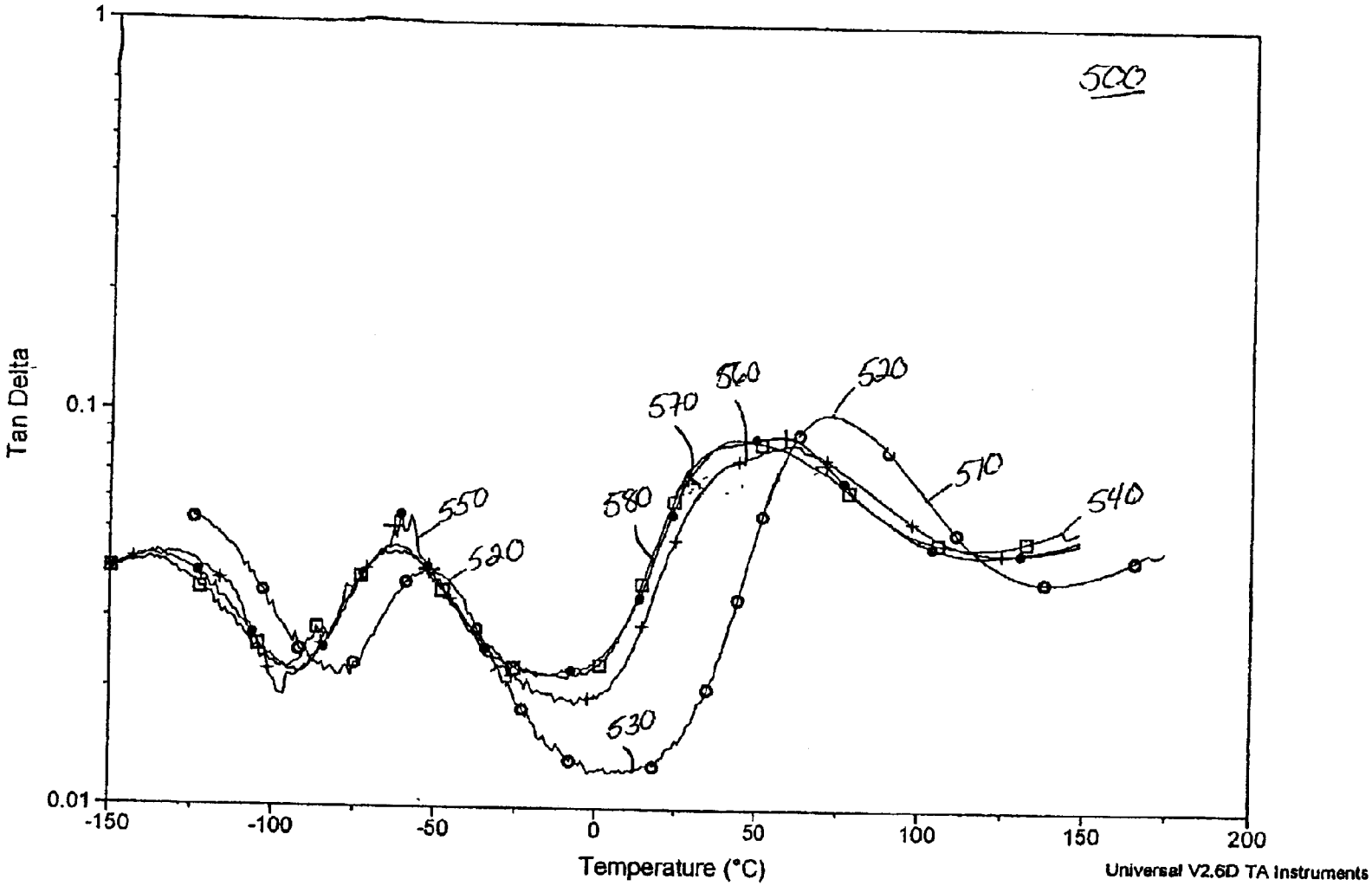
FIG. 5 illustrates the Dynamic Mechanical Analysis behavior of a 6,12 nylon polishing pad as a function of temperature.

FIG. 5 illustrates the DMA behavior 500 of a 6,12 nylon under similar conditions. Line 510 indicates the mechanical properties of the pad before being exposed to an aqueous medium. The pre-soak behavior 510 is characterized by maxima 520 at about −52.0° C. and 71.0° C. and a minimum 530 at about 5° C. The behavior after soaking in water for 2 weeks is illustrated by line 540. Line 540 has a pronounced maximum 550 of at about −62.8° C. and another broader maximum 560 at about 50° C. to about 59° C. Line 570 shows the DMA behavior of samples of 6,12 nylon were soaked in water in the presence of a pH 10 buffer and silica. Other samples were soaked in an acidic buffer pH 4.0 in the presence of alumina. The behavior of these samples is shown by two nearly coincident lines 580. The DMA behavior of these samples substantially resembles that of the sample soaked in only water. These data are also collected in TABLE II.

TABLE II

| Pad material | Soak Medium | Additive | DMA Maxima | DMA Minima |
|---|---|---|---|---|
| 6,12 Nylon | none | none | −52° C., 71° C. | 5° C. |
| 6,12 Nylon | water | none | 62.8° C. | 50–59° C. |
| 6,12 Nylon | water | acidic buffer/$Al_2O_3$ | 62.8° C. | 50–59° C. |
| 6,12 Nylon | water | basic buffer/$SiO_2$ | 62.8° C. | 50–59° C. |

Figure 6:
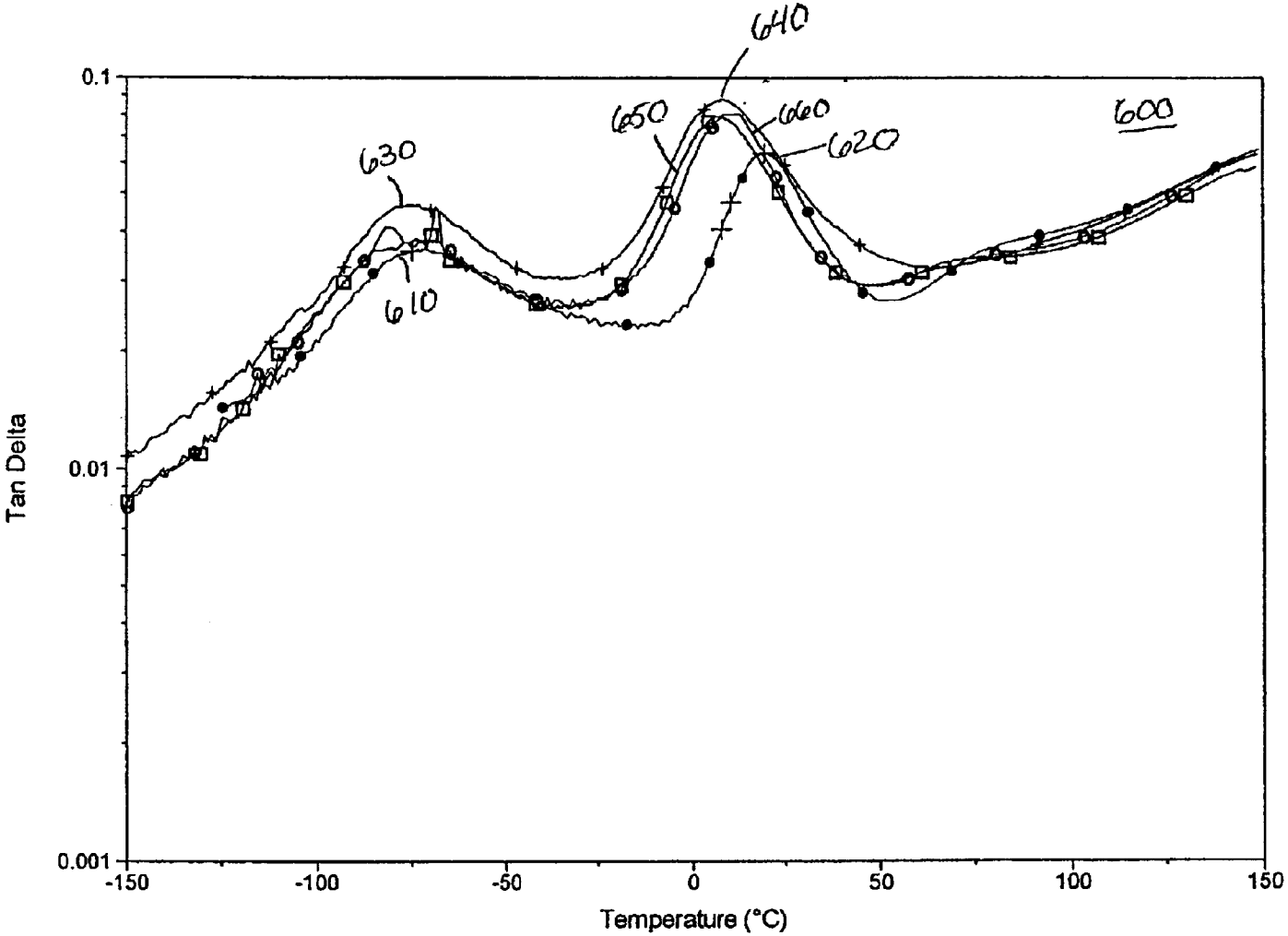
FIG. 6 illustrates the Dynamic Mechanical Analysis behavior of a polykeytone polishing pad as a function of temperature.

Polyketones were also studied. Examples of suitable polyketones are Carilon FX-100 and Carilon HM-700 manufactured by Shell Chemical Co. of Houston, Tex. FIG. 6 illustrates the DMA behavior of Carilon HM-700 samples. The as-received sample of Carilon HM-700 has a characteristic peak 610 at about −75.0° C. and another peak 620 at about 20° C. Samples were soaked in deionized water for 2 weeks. These samples show peaks 630 and 640 at about −75.0° C. and about 0° C. to about 11° C. The results from a representative'sample soaked in acidic buffer having a pH of 4 in the presence of alumina are indicated by line 650 and showed substantially similar behavior. Results of samples soaked in pH 10 buffer in the presence of silica have DMA behavior 660 with maxima at about −75° C. and about 13° C. The behavior of Carilon FX-100 samples is very similar to that of the Carilon HM-700 samples. This data is also represented in TABLE III.

TABLE III

| Pad material | Soak Medium | Additive | DMA Maxima | DMA Minima |
|---|---|---|---|---|
| Carilon XM-700 | none | none | −75° C., 20° C. | — |
| Carilon HM-700 | water | none | −75.0° C., 0° C. −11° C. | — |

TABLE III-continued

| Pad material | Soak Medium | Additive | DMA Maxima | DMA Minima |
|---|---|---|---|---|
| Carilon HM-700 | water | acidic buffer/$Al_2O_3$ | −75.0° C., 0° C. −11° C. | — |
| Carilon HM-700 | water | basic buffer/$SiO_2$ | −75.0° C., 0° C. −11° C. | — |
| Carilon FX-100 | none | none | −75.0° C., 22° C. | ~−40° C. |
| Carilon FX-100 | water | none | −75.0° C., 5.5° C. | ~−40° C. |
| Carilon FX-100 | water | acidic buffer/$Al_2O_3$ | −75.0° C., 5.9° C. | ~−40° C. |
| Carilon FX-100 | water | basic buffer/$SiO_2$ | −75.0° C., 12° C. | ~−40° C. |

Figure 7:
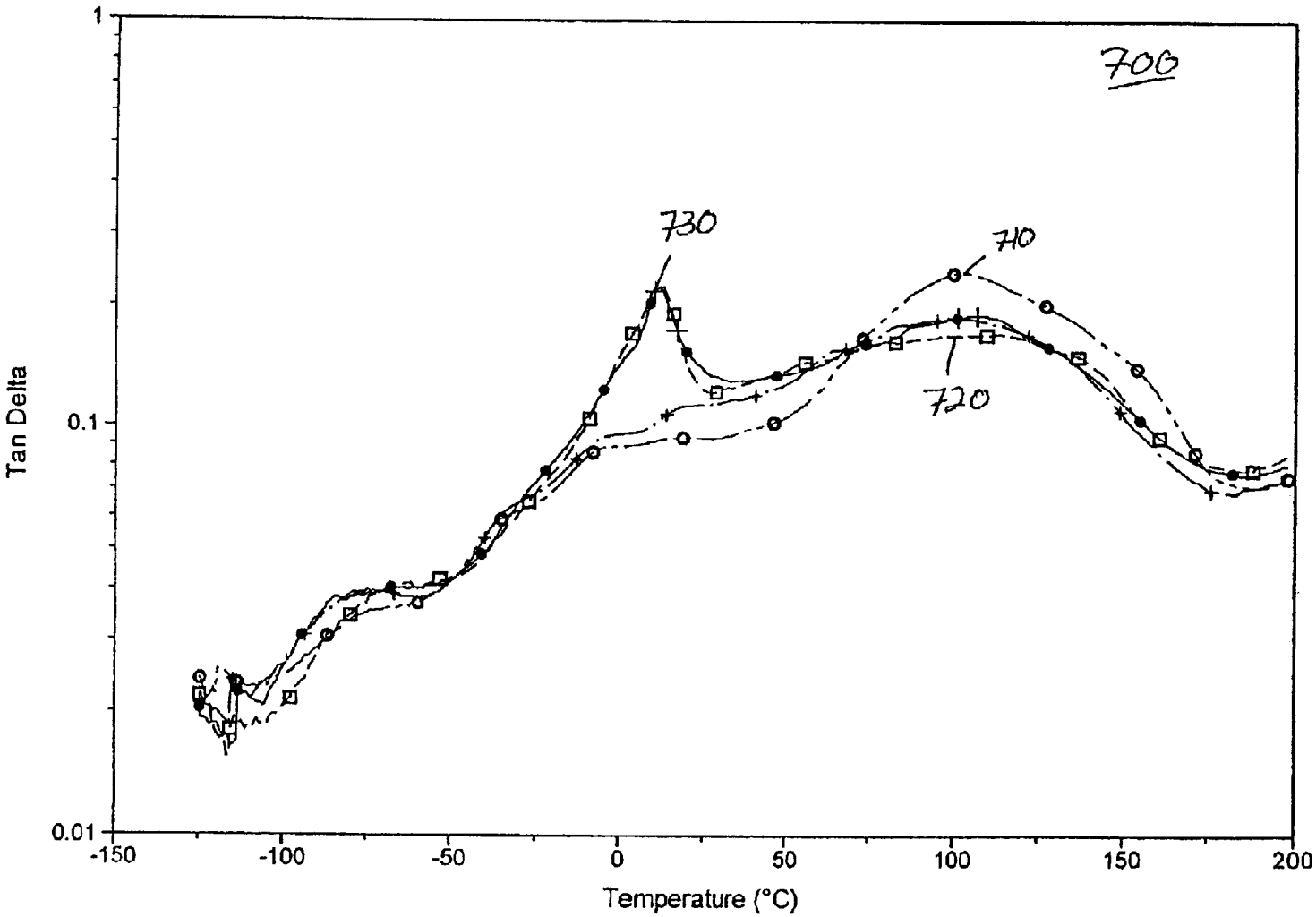
FIG. 7 illustrates the Dynamic Mechanical Analysis behavior of a polyurethane polishing pad as a function of temperature.

Commercially available polyurethane composite pads were also studied. Such polishing pads are commercially available from Rodel, Corp. of Newark, Delaware under the name IC100/SBA IV. The DMA analysis of the polyurethane sample is illustrated in FIG. 7. As-recieved polyurethane pads and pads soaked in deionized water both show very broad maxima 710, 720, respectively, at about 100° C. In contrast, samples soaked in an acidic buffer having a pH of 4.0 and alumina exhibit a sharp maxima 730 at about 10.5° C. Samples soaked for 24 hours in a pH 10 buffer and silica exhibit similar DMA results. These data are collected in TABLE IV.

TABLE IV

| Pad material | Soak Medium | Additive | DMA Maxima | DMA Minima |
|---|---|---|---|---|
| IC 100/SBA IV | none | none | 101° C. | — |
| IC 100/SBA IV | water | none | 100° C. | — |
| IC 100/SBA IV | water | acidic buffer | 10.5° C. | — |
| IC 100/SBA IV | water | basic buffer | 10.5° C. | — |

Thus, soaking the pad materials in an aqueous medium at ambient temperature and pressure can alter the mechanical properties of the polishing pad. Importantly, soaking not only alters, but also stabilizes the pad properties. Thus, once soaked, a polishing pad may be used to polish without rapid changes in the polishing properties.

Although present invention has been described in detailed, those skilled in the art should understand that they can make various changes, substitutions and alterations herein without departing from the spirit and scope of the invention in its broadest form.

What is claimed is:

1. A packaged polishing pad, comprising:

a sealable moisture tight package having a dimension sufficient to contain a polishing pad therein; and a polishing pad soaked in an aqueous medium comprising an additive configured to simulate a CMP slurry and located within the sealable moisture tight package, wherein said polishing pad is configured for use in chemical mechanical polishing of a semiconductor wafer in conjunction with a polishing slurry.

2. The packaged polishing pad as recited in claim 1 wherein the aqueous media is at about 10 C. to 45 C. and ambient pressure.

3. The packaged polishing pad as recited in claim 1 wherein the polishing pad is equilibrated with the aqueous media to at least about 10% to about 50% of the pad's maximum absorbency.

4. The packaged polishing pad as recited in claim 1 wherein the pad comprises a polymer selected from the group consisting of:

6.6 nylon;

6.12 nylon;

polyketone; and polyurethane.

5. The packaged polishing pad as recited in claim 1 wherein the additive comprises a buffer.

6. The packaged polishing pad as recited in claim 5 wherein the buffer is an acidic buffer having a pH ranging from about 2.0 to about 7.0.

7. The packaged polishing pad as recited in claim 5 wherein the buffer is a basic buffer having a pH ranging from about 7.0 to about 14.0.

8. The packaged polishing pad as recited in claim 1 wherein the additive is selected from the group consisting of an oxidant, an abrasive, and an organic amine.

9. The packaged polishing pad as recited in claim 8 wherein the organic amine is ethanol amine.

10. The packaged polishing pad as recited in claim 8 wherein the additive comprises an abrasive and the abrasive is selected from the group consisting of alumina and silica.

11. The packaged polishing pad as recited in claim 1 wherein the sealable moisture tight package is comprised of a flexible plastic material.

12. The packaged polishing pad as recited in claim 11 wherein the flexible plastic material is a heat sealable material.

13. The packaged polishing pad as recited in claim 11 wherein the flexible plastic material is mechanically sealable.

14. The packaged polishing pad as recited in claim 1 wherein the polishing slurry further includes an abrasive.

* * * * *